US008693722B2

(12) United States Patent
Liu

(10) Patent No.: US 8,693,722 B2
(45) Date of Patent: Apr. 8, 2014

(54) MAGNETIC SOUND BOX DEVICE

(75) Inventor: Keng-Yuan Liu, New Taipei (TW)

(73) Assignee: Ozaki International Co. Ltd., New Taipei (TW)

( * ) Notice: Subject to any disclaimer, the term of this patent is extended or adjusted under 35 U.S.C. 154(b) by 0 days.

(21) Appl. No.: 13/534,207

(22) Filed: Jun. 27, 2012

(65) Prior Publication Data

US 2014/0003647 A1 Jan. 2, 2014

(51) Int. Cl.
*H04R 1/02* (2006.01)
*H04R 25/00* (2006.01)

(52) U.S. Cl.
USPC ..... 381/386; 381/189; 381/198; 381/391

(58) Field of Classification Search
CPC ..... H04R 1/083; H04R 9/02; H04R 9/06; H04R 19/02; H04R 19/00; H04R 19/01; H04R 1/023; H04R 1/025; H04R 2201/021
USPC ..... 381/189, 198, 386, 391; 361/679.5
See application file for complete search history.

(56) References Cited

U.S. PATENT DOCUMENTS 6,999,597 B2 * 2/2006 Yang ..... 381/386
2006/0126438 A1 * 6/2006 Itou et al. ..... 368/47
2007/0009131 A1 * 1/2007 Kuan ..... 381/334
2010/0105984 A1 * 4/2010 Brewer et al. ..... 600/118
2012/0183170 A1 * 7/2012 Chen ..... 381/386
2012/0300968 A1 * 11/2012 Sun ..... 381/353
2013/0033807 A1 * 2/2013 Kim ..... 361/679.01
2013/0050973 A1 * 2/2013 Rohrbach ..... 361/807
2013/0058065 A1 * 3/2013 Minaguchi et al. ..... 361/807
2013/0177186 A1 * 7/2013 Schul ..... 381/300

* cited by examiner

*Primary Examiner* — Duc Nguyen
*Assistant Examiner* — Sean H Nguyen

(57) ABSTRACT

A magnetic sound box device comprising a sound box and an antimagnetic plate is disclosed, wherein the sound box has at least one speaker and the sound box is for receiving sound source signals from an electronic device and transmitting the sound source signals to the speaker to play the sound source signals, and the lateral side of the sound box is disposed with a coupling portion; a plurality of magnets is disposed on the coupling portion so that the sound box can be magnetically attracted to any objects capable of being attracted by the magnets; the antimagnetic plate is disposed on the sound box for covering the coupling portion for blocking the magnetism of the magnets on the coupling portion, thereby preventing other storage devices with magnetic materials from being affected and damaged by the magnetism of the magnets when the magnetic sound box device is carried.

11 Claims, 6 Drawing Sheets

MAGNETIC SOUND BOX DEVICE

BACKGROUND OF THE INVENTION

1. Field of Invention

The present invention relates to a magnetic sound box device and more particularly to a magnetic sound box device which can be magnetically attracted to a protection case of an electronic device. A sound box of the magnetic sound box device is disposed with a movable antimagnetic plate. Thereby, when the magnetic sound box device is carried around, the magnetism of magnets on a coupling portion of the magnetic sound box device can be blocked by the antimagnetic plate.

2. Related Art

In the post-PC era, portable electronic devices such as smart phone and tablet computer are equipped with internet connection. Because smart phone and tablet computer are compact in size and convenient to use, they are gradually replacing personal computer and have become the most common electronic devices used in daily life.

Thanks to the popularity of smart phone and tablet computer, related application software has been introduced and various peripheral accessories have been developed for the markets. For example, protection case is available for preventing the surfaces of smart phone and tablet computer from being scrubbed or scratched by objects. Some protection cases can even make a tablet computer to stand on a table for convenience of usage. Devices such as headphones, earphones and mini-speakers for playing sound and music are commonly used because they are compact in size, convenient to carry around and can be operated without batteries. On the contrary, even though conventional sound box is bulky, not convenient for carrying around and requires electricity for playing sound and music, larger sound volumes are available for the ultimate enjoyment of listening to music. All the afore-mentioned conventional devices for playing sound and music can not provide the advantages of compactness and large volumes at the same time, and tablet computer can not be placed uprightly on a table by using the devices. Therefore, there is room for improvement for such conventional devices.

In view of the above problems, a magnetic sound box device of the present invention is provided for improving the drawbacks. The magnetic sound box device is convenient for carrying around and can provide larger sound volumes. An electronic device can be supported by the magnetic sound box device after it is combined with the electronic device.

SUMMARY OF THE INVENTION

A primary objective of the present invention is to provide a magnetic sound box device. By using a plurality of magnets disposed on a coupling portion of a sound box, the sound box can be magnetically attracted to a metal part of a case or a protection case of an electronic device. Thereby, the magnetic sound box is combined on the electronic device and the electronic device can be supported on a surface. The sound source signals of the electronic device are received and played by the magnetic sound box device.

A secondary objective of the present invention is to provide a magnetic sound box device. By using an antimagnetic plate disposed on the sound box to cover the coupling portion, when the magnetic sound box device is carried around, the magnetism of the magnets on the coupling portion can be blocked by the antimagnetic plate, and other storage devices with magnetic materials can be prevented from being affected and damaged by the magnetism of the magnets.

In order to achieve the above-mentioned objectives, the present invention of a magnetic sound box device comprises a sound box and an antimagnetic plate. The sound box has at least one speaker and the sound box is for receiving sound source signals from an electronic device and transmitting the sound source signals to the speaker to play the sound source signals. A lateral side of the sound box is disposed with a coupling portion. A plurality of magnets is disposed on the coupling portion. The antimagnetic plate is disposed on the sound box for covering the coupling portion in order to block the magnetism of the magnets on the coupling portion.

When the magnetic sound box device is embodied, a lateral edge of the antimagnetic plate is movably connected to a periphery of the coupling portion.

When the magnetic sound box device is embodied, the antimagnetic plate comprises an outer covering layer and an inner antimagnetic sheet, and the inner antimagnetic sheet is made with an antimagnetic material or a magneto-conductive material.

When the magnetic sound box device is embodied, a positioning element is further disposed on the coupling portion, and a position limiting structure is disposed on a coupling surface of the electronic device connected to the coupling portion for coupling with the positioning element.

When the magnetic sound box device is embodied, the positioning element is a positioning groove, and the position limiting structure is a position limiting block for inserting into the positioning groove.

When the magnetic sound box device is embodied, a sound source signal processing module and an electrical source module are further disposed in the sound box. The sound source signal processing module amplifies the sound source signals and transmits the amplified sound source signals to the speaker. The electrical source module supplies electricity to the sound source signal processing module.

When the magnetic sound box device is embodied, the sound source signal processing module comprises a wire connection interface for connecting with the electronic device to obtain the sound source signals.

When the magnetic sound box device is embodied, the wire connection interface is a universal serial bus (USB) interface or a sound source importing insertion hole.

When the magnetic sound box device is embodied, the electrical source module comprises a chargeable battery unit.

When the magnetic sound box device is embodied, the sound source signal processing module comprises a wireless connection interface for connecting with the electronic device to obtain the sound source signals.

The present invention will become more fully understood by reference to the following detailed description thereof when read in conjunction with the attached drawings.

DETAILED DESCRIPTION OF THE INVENTION

Figure 1B:
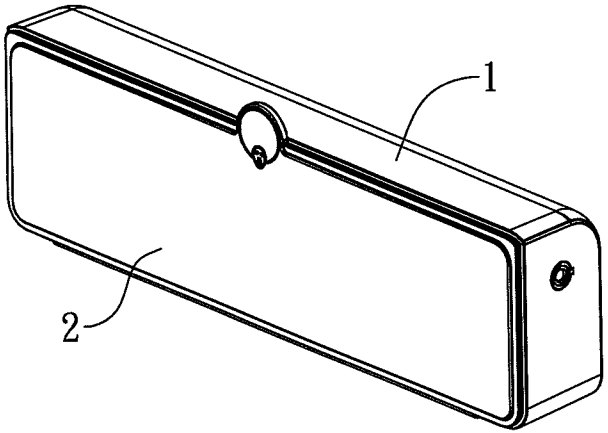
FIG. 1B is a back perspective view of the embodiment in FIG. 1A.
Figure 1A:
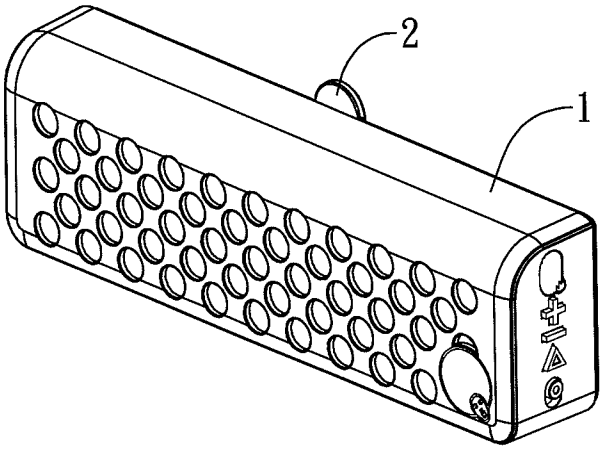
FIG. 1A is a front perspective view of a magnetic sound box device according to an embodiment of the present invention.
Figure 2B:
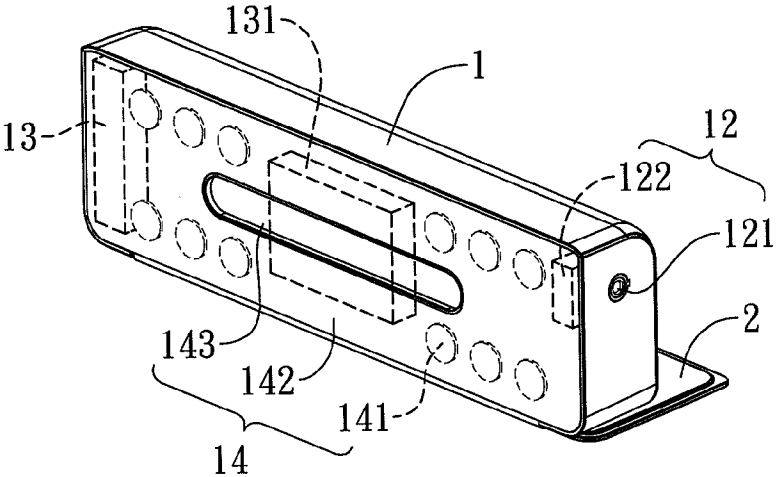
FIG. 2B is a back perspective view of the embodiment in FIG. 1A with the antimagnetic plate turned underneath the sound box.
Figure 2A:
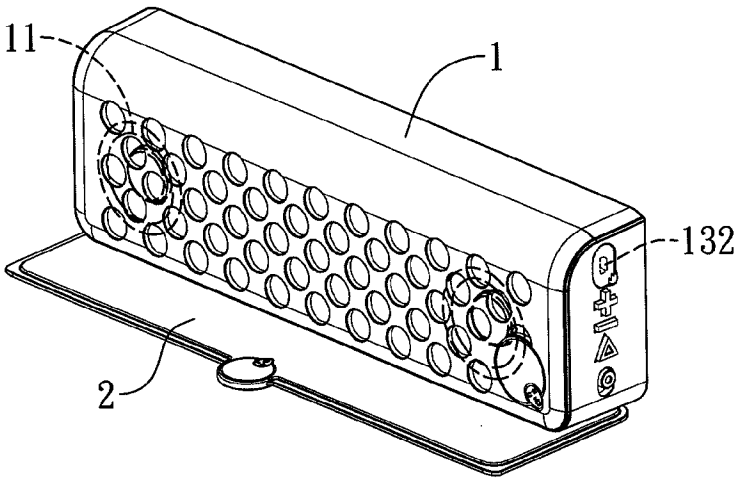
FIG. 2A is a front perspective view of the embodiment in FIG. 1A with an antimagnetic plate turned underneath a sound box.
Figure 3B:
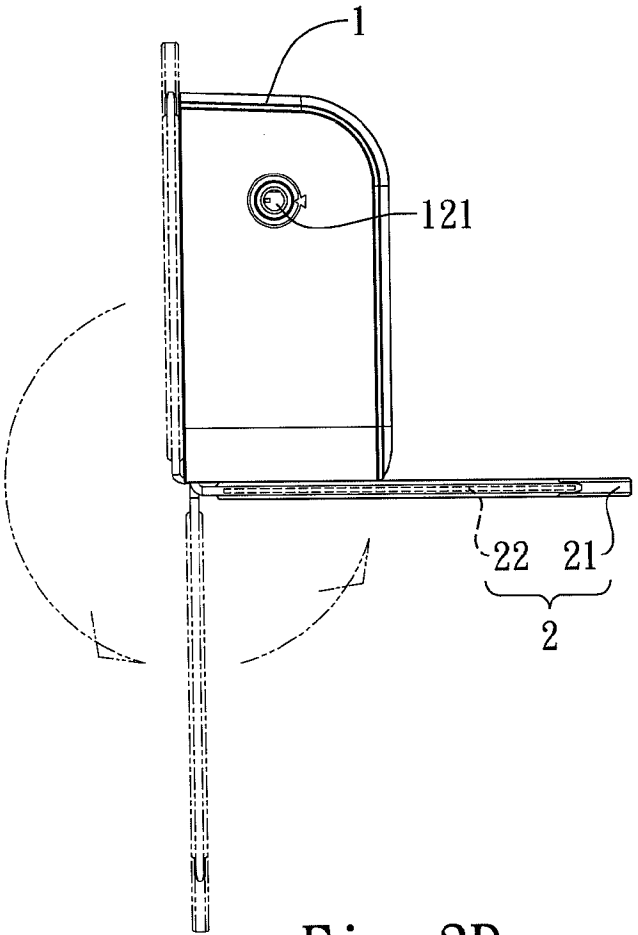
FIG. 3B is an illustration of the embodiment in FIG. 1A with the antimagnetic plate being turned.
Figure 3A:
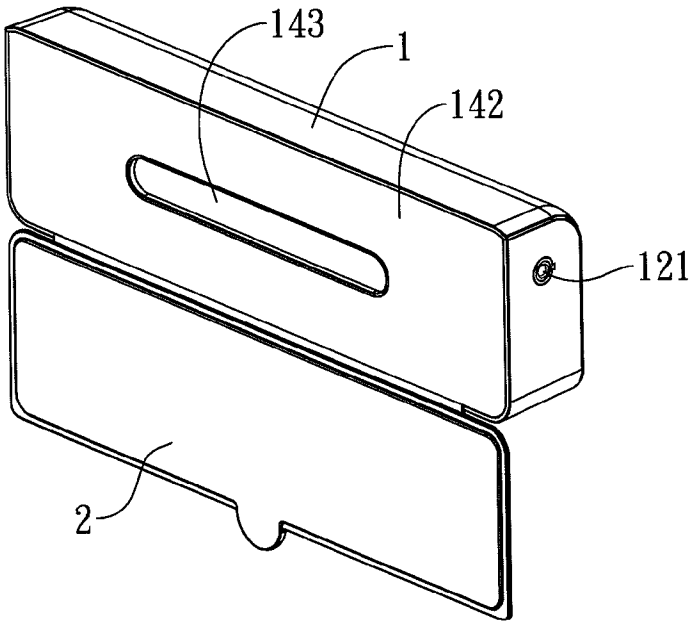
FIG. 3A is a back perspective view of the embodiment in FIG. 1A with the antimagnetic plate not yet magnetically attracted to magnets.

FIGS. 1A to 3B are illustrations of a magnetic sound box device according to an embodiment of the present invention. The magnetic sound box device comprises a sound box 1 and an antimagnetic plate 2.

A plurality of speakers 11, a sound source signal processing module 12 and an electrical source module 13 are disposed in the sound box 1. The sound source signal processing module 12 comprises a wire connection interface 121 and a wireless connection interface 122 for connecting with an electronic device (not shown in the drawings) in order to receive sound source signals from the electronic device and to amplify the sound source signals, and to transmit the amplified sound source signals to the speakers 11 to play the sound source signals. The wire connection interface 121 is a sound source importing insertion hole for connecting with the electronic device electrically and obtaining the sound source signals. The wireless connection interface 122 is a wireless Bluetooth receiving and transmitting interface, and the sound source signal processing module 12 connects with a wireless Bluetooth receiving and transmitting unit of the electronic device via the wireless Bluetooth receiving and transmitting interface 122 in order to obtain the sound source signals. The electrical source module 13 comprises a chargeable battery unit 131 and a universal serial bus (USB) interface 132. The chargeable battery unit 131 supplies electricity to the sound source signal processing module 12. The sound source signal processing module 12 and the electrical source module 13 obtains the sound source signals and an external power supply via the universal serial bus (USB) interface 132, and the chargeable battery unit 131 is charged with electricity.

A coupling portion 14 is disposed on a back side of the sound box 1, and six magnets 141 are disposed on a left part and a right part of the coupling portion 14 respectively. The back side of the sound box 1 and the magnets 141 are covered by a back plate 142 of the coupling portion 14. A positioning element 143 like a positioning groove is concavely disposed at a middle of the back plate 142.

The antimagnetic plate 2 comprises an outer covering layer 21 and an inner antimagnetic sheet 22. The inner antimagnetic sheet 22 is made with an antimagnetic material or a magneto-conductive material, and the outer covering layer 21 is made with rubber. An upper edge of the antimagnetic plate 2 is connected with a lower periphery of the back side of the sound box 1, therefore the antimagnetic plate 2 can be movably connected to the periphery of the coupling portion 14, and the antimagnetic plate 2 can be turned relative to the sound box 1. Thereby, by turning the antimagnetic plate 2 to cover the coupling portion 14 of the sound box 1, the inner antimagnetic sheet 22 of the antimagnetic plate 2 is attracted to the magnets 141 of the coupling portion 14, and the magnetism of the magnets 141 of the coupling portion 14 can be blocked by the inner antimagnetic sheet 22.

Figure 4:
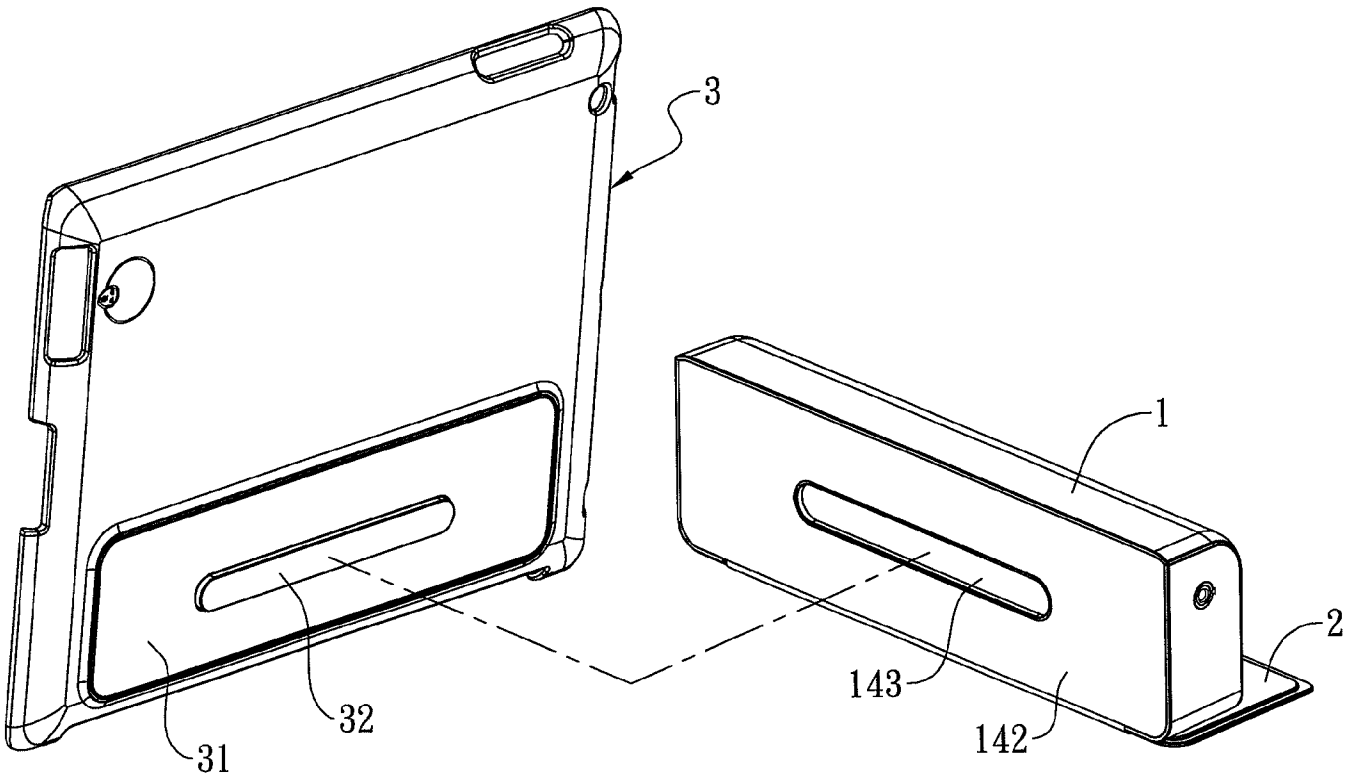
FIG. 4 is an assembly illustration of the embodiment in FIG. 1A being connected to a back side of a protection case of an electronic device.
Figure 6:
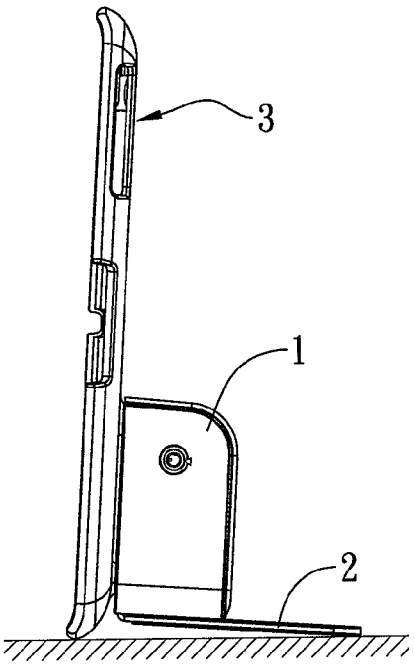
FIG. 6 is a lateral perspective view of the embodiment in FIG. 1A connected to the back side of the protection case of the electronic device.
Figure 5:
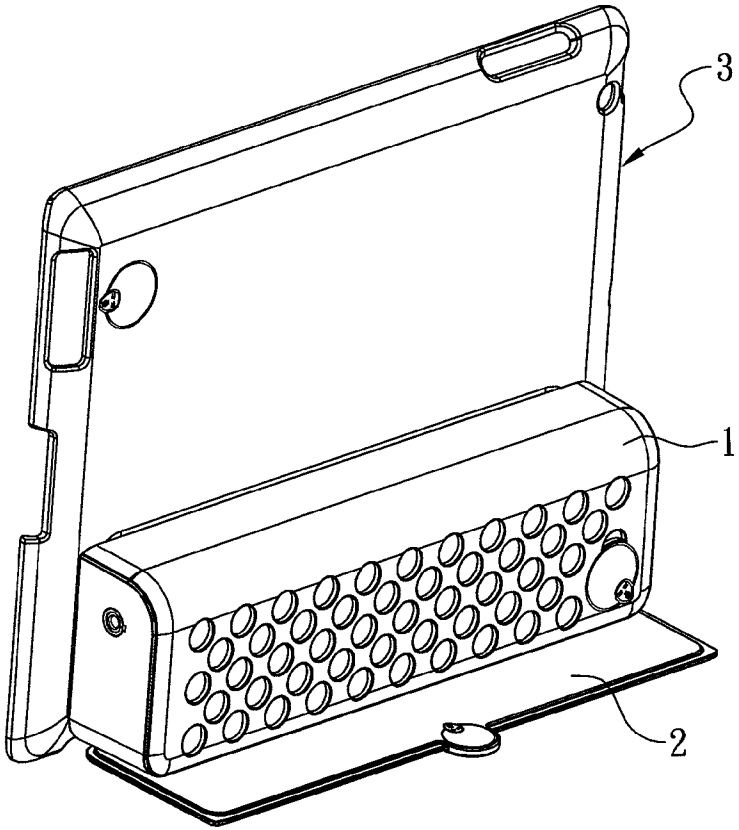
FIG. 5 is a back perspective view of the embodiment in FIG. 1A connected to the back side of the protection case of the electronic device.
Figure 8:
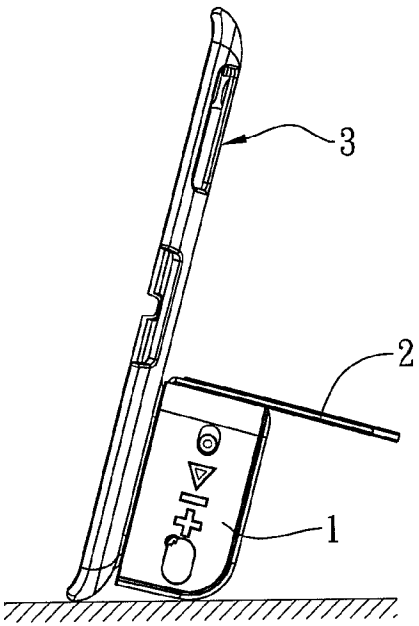
FIG. 8 is another lateral perspective view of the embodiment in FIG. 1A connected to the back side of the protection case of the electronic device.
Figure 7:
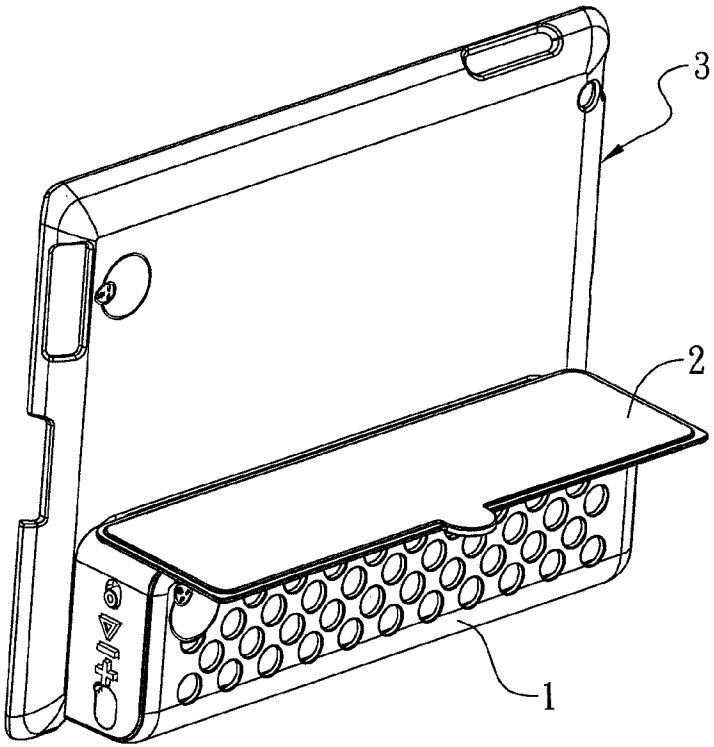
FIG. 7 is another back perspective view of the embodiment in FIG. 1A connected to the back side of the protection case of the electronic device.

Please refer to FIG. 4. When the magnetic sound box device is embodied, the coupling portion 14 on the back side of the sound box 1 can be magnetically attracted to a metal plate 31 of a protection case 3 of the electronic device. The metal plate 31 of the protection case 3 of the electronic device can be made with a metal, such as iron, which possesses magnetism after it is attracted or magnetized by the magnets 141. A position limiting structure 32 like a position limiting block is convexly disposed at a middle of the metal plate 31 in order that the position limiting structure 32 can be inserted into the positioning groove 143 of the sound box 1 to prevent the sound box 1 from sliding on the protection case 3 of the electronic device. Therefore, when the antimagnetic plate 2 is turned underneath the sound box 1 and the sound box 1 is magnetically attracted to a back side of the protection case 3 of the electronic device, the protection case 3 of the electronic device can be stand on a surface by the supporting of the antimagnetic plate 2 as shown in FIGS. 5 and 6. Or the sound box 1 with the antimagnetic plate 2 can be turned upside down and the sound box 1 is magnetically attracted to the back side of the protection case 3 of the electronic device, the protection case 3 of the electronic device can be stand on a surface by the supporting of the sound box 1 as shown in FIGS. 7 and 8. Thereby, a screen of the electronic device (e.g. a screen of a tablet computer) disposed inside the protection case 3 can be viewed with different angles.

Therefore, the magnetic sound box device of the present invention has the following advantages:

1. The magnetic sound box device is compact and convenient to carry around. The sound source signals from the electronic device can be played via the wire or wireless connection. After the magnetic sound box device is coupled with the back side of the protection case of the electronic device, it can support the protection case of the electronic device, and so that the practicability and additional value of the magnetic sound box device can be enhanced.

2. The magnetism of the magnets on the coupling portion of the sound box can be blocked by the antimagnetic plate in order to prevent other storage devices with magnetic materials from being damaged by the magnets before the magnetic sound box device is magnetically attracted to the metal case or protection case of the electronic device.

3. The magnetic sound box device can be used revolutionarily in comparing with conventional sound box speakers. The magnets on the coupling portion of the sound box can generate strong magnetism, therefore the sound box can be magnetically attracted to any objects, such as the metal case of desktop computer, metal plates of office furniture or vertical surfaces that the magnets can be attracted to, which possessing magnetism after they are attracted or magnetized by the magnets. Furthermore, the sound box can receive the sound source signals via the wire or wireless connection. Therefore, the magnetic sound box device of the present invention can be used in many different ways with flexibility.

According to the disclosure mentioned above, the magnetic sound box device of the present invention can achieve the objectives. The magnetic sound box device is convenient to carry around and can be used for supporting the protection case of the electronic device; and at the same time, other storage devices with magnetic materials can be prevented from being affected and damaged by the magnets.

Although the embodiments of the present invention have been described in detail, many modifications and variations may be made by those skilled in the art from the teachings disclosed hereinabove. Therefore, it should be understood that any modification and variation equivalent to the spirit of the present invention be regarded to fall into the scope defined by the appended claims.

What is claimed is:

1. A magnetic sound box device for use with an electronic device comprising a coupling surface, comprising:

a sound box, comprising:

at least one speaker, configured to receive and play sound source signals from the electronic device; and a coupling portion disposed at a side of the sound box, the coupling portion comprising a plurality of magnets and configured to couple to the coupling surface of the electronic device; and an antimagnetic plate movably connected to the sound box, arranged such that in a first position the antimagnetic plate covers the coupling portion in order to block the magnetism of the magnets of the coupling portion, and in a second position the antimagnetic plate exposes the coupling portion.

2. The magnetic sound box device as claimed in claim 1, wherein a lateral edge of the antimagnetic plate is movably connected to a periphery of the coupling portion.

3. The magnetic sound box device as claimed in claim 1, wherein the antimagnetic plate comprises an outer covering layer and an inner antimagnetic sheet, and the inner antimagnetic sheet is made with an antimagnetic material or a magneto-conductive material.

4. The magnetic sound box device as claimed in claim 1, wherein a positioning element is further disposed on the coupling portion, and a position limiting structure is disposed on the coupling surface of the electronic device connected to the coupling portion for connecting to the positioning element.

5. The magnetic sound box device as claimed in claim 4, wherein the positioning element is a positioning groove, and the position limiting structure is a position limiting block for inserting into the positioning groove.

6. The magnetic sound box device as claimed in claim 1, wherein the sound box further comprises a sound source signal processing module and an electrical source module, the sound source signal processing module configured to amplify the sound source signals and transmit the amplified sound source signals to the speaker, and the electrical source module supplying electricity to the sound source signal processing module.

7. The magnetic sound box device as claimed in claim 6, wherein the sound source signal processing module comprises a wire connection interface for connecting with the electronic device to obtain the sound source signals.

8. The magnetic sound box device as claimed in claim 7, wherein the wire connection interface is a universal serial bus (USB) interface or a sound source importing insertion hole.

9. The magnetic sound box device as claimed in claim 6, wherein the electrical source module comprises a chargeable battery unit.

10. The magnetic sound box device as claimed in claim 6, wherein the sound source signal processing module comprises a wireless connection interface for connecting with the electronic device to obtain the sound source signals.

11. The magnetic sound box device as claimed in claim 1, wherein the antimagnetic plate is configured to provide a support for standing the electronic device when in the second position with the coupling portion of the sound box coupled to the coupling surface of the electronic device.

* * * * *